US007646154B2

(12) United States Patent
Kang et al.

(10) Patent No.: US 7,646,154 B2
(45) Date of Patent: Jan. 12, 2010

(54) LIGHT EMITTING APPARATUS AND CONTROL METHOD THEREOF

(75) Inventors: Jeong-il Kang, Yongin-si (KR); Sang-hoon Lee, Ulsan (KR); Yung-jun Park, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 152 days.

(21) Appl. No.: 11/589,809

(22) Filed: Oct. 31, 2006

(65) Prior Publication Data

US 2007/0103905 A1 May 10, 2007

(30) Foreign Application Priority Data

Nov. 8, 2005 (KR) ..... 10-2005-0106459

(51) Int. Cl.
*H05B 37/00* (2006.01)

(52) U.S. Cl. ..... 315/312

(58) Field of Classification Search ..... 315/128, 315/122, 312, 247, 185 R, 291, 294
See application file for complete search history.

(56) References Cited

U.S. PATENT DOCUMENTS 3,796,951 A * 3/1974 Joseph ..... 324/122
4,017,796 A * 4/1977 Tobias ..... 324/122
4,198,629 A * 4/1980 Marion ..... 345/46
5,933,130 A * 8/1999 Wagner ..... 345/690
7,317,403 B2 * 1/2008 Grootes et al. ..... 340/815.45
2003/0178946 A1 9/2003 Nakamura et al.
2005/0243022 A1 * 11/2005 Negru ..... 345/46
2006/0038803 A1 * 2/2006 Miller et al. ..... 345/204

FOREIGN PATENT DOCUMENTS

CN 1294375 5/2001
CN 1691126 11/2005
JP 08-054835 2/1996
JP 2003-098997 4/2003

* cited by examiner

*Primary Examiner*—Douglas W Owens
*Assistant Examiner*—Minh D A
(74) *Attorney, Agent, or Firm*—Roylance, Abrams, Berdo & Goodman, LLP

(57) ABSTRACT

An apparatus and method for controlling emission of light are provided. The light emitting apparatus comprises a plurality of first light emitting parts which are connected with each other in series, a first current supply which supplies a current to the plurality of first light emitting parts, a plurality of switches which are respectively connected with the plurality of first light emitting parts in parallel to make the current be transmitted to or bypass the first light emitting parts and a controller which receives brightness information corresponding to the respective first light emitting parts and controls the plurality of first switches to make overall light emitting time of the first light emitting parts within time intervals correspond to a brightness level of the brightness information. The present invention provides an apparatus and method for emitting light by driving a plurality of light emitting parts to independently emit light in various brightness levels with a simplified circuit configuration and improved efficiency.

20 Claims, 7 Drawing Sheets

LIGHT EMITTING APPARATUS AND CONTROL METHOD THEREOF

CROSS-REFERENCE TO RELATED APPLICATIONS

This application claims the benefit under 35 U.S.C. §119 (a) of Korean Patent Application No. 2005-0106459, filed on Nov. 8, 2005, in the Korean Intellectual Property Office, the entire disclosure of which is hereby incorporated by reference.

BACKGROUND OF THE INVENTION

1. Field of the Invention

The present invention relates to a light emitting apparatus and a control method thereof. More particularly, the present invention relates to a light emitting apparatus which controls a plurality of LEDs.

2. Description of the Related Art

Generally, a light emitting apparatus comprises a plurality of light emitting parts such as an LED array arranged in a matrix pattern and a display part such as a liquid crystal display (LCD) panel. The plurality of light emitting parts function as a light source to display a predetermined image on the display part.

FIGS. 1*a* and 1*b* illustrate an example of a conventional light emitting apparatus. As shown in FIG. 1*a*, a light emitting apparatus 1*a* comprises nine LEDs 10*a* to 10*c*, 20*a* to 20*c*, and 30*a* to 30*c* and driving circuits 11*a* to 11*c*, 21*a* to 21*c* and 31*a* to 31*c* which respectively control the nine LEDs 10*a* to 10C, 20*a* to 20*c* and 30*a* to 30*c*. The light emitting apparatus 1*a* may sequentially control a brightness level of the nine LEDs 10*a* to 10*c*, 20*a* to 20*c* and 30*c* to 30*c* through the driving circuits 11*a* to 11*c*, 21*a* to 21*c* and 31*a* to 31*c*. The nine LEDs 10*a* to 10*c*, 20*a* to 20*c*, and 30*a* to 30*c* may comprise a single color or various colors through a mixture of certain colors of the LEDs.

As the driving circuits 11*a* to 11*c*, 21*a* to 21*c* and 31*a* to 31*c* which are respectively distributed to the nine LEDs 10*a* to 10*c*, 20*a* to 20*c*, and 30*a* to 30*c* receive a signal i1, i4, i7; i2, i5, i8 and i3, i6, i9 respectively, the light emitting apparatus 1*a* may drive the respective LEDs 10*a* to 10*c*, 20*a* to 20*c* and 30*a* to 30*c* to emit light in a certain brightness level or to realize a desired image.

However, with this configuration, the greater the number of the LEDs, the greater the number of the driving circuits and the driving signals. When the LEDs are arranged in the same density, the number of driving circuits and driving signals increases in proportion to a square of an area, thereby causing impracticability.

As shown in FIG. 1*b*, a light emitting apparatus 1*b* comprises nine LEDs 12*a* to 12*c*, 22*a* to 22*c* and 32*a* to 32*c* which are arranged in three columns and three rows, three driving circuits 13*a* to 13*c* which control respective columns of the nine LEDs 12*a* to 12*c*, 22*a* to 22*c* and 32*a* to 32*c* and three switches 14, 24 and 34 which control respective rows of the nine LEDs 12*a* to 12*c*, 22*a* to 22*c* and 32*a* to 32*c*.

The light emitting apparatus 1*b* sequentially turns on the three switches 14, 24 and 34 at predetermined time intervals, and supplies a driving current i1, i2 and i3 corresponding to the respective LEDs 12*a* to 12*c*, 22*a* to 22*c* and 32*a* to 32*c* which are disposed in the turned-on row to emit light. After the LEDs 32*a* to 32*c* in the last row emit light, the light emitting apparatus 1*b* drives the LEDs 12*a* to 12*c* in the first row to emit light again. When the LEDs in the respective rows are sequentially driven at a fast speed, the human eye does not recognize the change of the light, but recognizes average brightness of the changing light (hereinafter, referred to as "brightness"). Thus, a user may feel that the respective LEDs are simultaneously driven in different brightness.

With this configuration, the number of driving circuits and driving signals corresponds to the number of rows of LEDs, thereby simplifying a circuit configuration. However, there is only one row of LEDs that continuously emit light, thereby lowering the efficiency of the LEDs. The human eye recognizes at best the brightness of the LEDs which is divided by the number of rows. To overcome such a disadvantage, switches may be provided in pairs or in groups, thereby simultaneously driving the LEDs in the rows included in the respective groups. However, in this case, the number of driving circuits and driving signals increases as the number of the groups increases.

Accordingly, there is a need for an improved light emitting apparatus having a simplified circuit configuration and improved efficiency that can drive light emitting parts to independently emit light at various brightness levels.

SUMMARY OF THE INVENTION

Exemplary embodiments of the present invention address at least the above problems and/or disadvantages and provide at least the advantages described below. Accordingly, it is an exemplary aspect of the present invention to provide a light emitting apparatus which drives a plurality of light emitting parts to independently emit light in various brightness levels with a simplified circuit configuration and improved efficiency, and a control method thereof.

Additional exemplary aspects and/or advantages of the present invention will be set forth in part in the description which follows and, in part, will be obvious from the description, or may be learned by practice of the present invention.

The foregoing and/or other exemplary aspects of the present invention are also achieved by providing a light emitting apparatus, the apparatus comprising a plurality of first light emitting parts which are connected with each other in series, a first current supply which supplies a current to the plurality of first light emitting parts, a plurality of switches which are respectively connected with the plurality of first light emitting parts in parallel to make the current be transmitted to or bypass the first light emitting parts and a controller which receives brightness information corresponding to the respective first light emitting parts and controls the plurality of first switches to make overall light emitting time of the first light emitting parts within time intervals correspond to a brightness level of the brightness information.

According to an exemplary embodiment of the present invention, the first switch comprises a first bypass transistor which is connected with the first light emitting parts in parallel to make the current bypass the first light emitting parts, when turned on.

According to an exemplary embodiment of the present invention, the apparatus further comprises a plurality of second light emitting parts which are connected with each other in series, a second current supply which supplies a current to the plurality of second light emitting parts and a plurality of second switches which are respectively connected with the plurality of second light emitting parts in parallel and make the current be transmitted to or bypass the second light emitting parts, and the controller receives brightness information corresponding to the respective second light emitting parts and controls the plurality of second switches to make overall light emitting time of the second light emitting parts within the time intervals correspond to a brightness level of the brightness information.

According to an exemplary embodiment of the present invention, the second switch comprises a second bypass transistor which is connected with the second light emitting part in parallel to make the current bypass the second light emitting part, when turned on.

According to an exemplary embodiment of the present invention, the first switch further comprises a first memory capacitor which is connected with the first bypass transistor and is charged with a voltage, and the second switch further comprises a second memory capacitor which is connected with the second bypass transistor and is charged with a voltage.

According to an exemplary embodiment of the present invention, the apparatus further comprises a first voltage supply which supplies a turn-on voltage to the first bypass transistor and the second bypass transistor and a plurality of column switch transistors which connect first ends of the plurality of first memory capacitors and first ends of the plurality of second memory capacitors, with one of the first voltage supply and the ground, and the controller controls the plurality of column switch transistors to be independently switched on and off based on the respective brightness information of the plurality of first and second light emitting parts.

According to an exemplary embodiment of the present invention, the apparatus further comprises a current switch transistor which allows the first current supply and the second current supply to supply a current, when turned on, and the controller turns on the current switch transistor when the plurality of first and second memory capacitors are fully charged.

According to an exemplary embodiment of the present invention, the apparatus further comprises a second voltage supply which supplies a voltage which is higher than the turn-on voltage of the first bypass transistor and the second bypass transistor, a first row switch transistor which connects second ends of the plurality of first memory capacitors, with one of the second voltage supply and the ground and a second row switch transistor which connects second ends of the plurality of second memory capacitors, with one of the second voltage supply and the ground, and the controller controls the first row switch transistor to be switched to connect the second ends of the plurality of first memory capacitors to the ground and the second row switch transistor to be switched to connect the second ends of the plurality of second memory capacitors to the second voltage supply, when the plurality of first memory capacitors are charged with a voltage.

According to an exemplary embodiment of the present invention, at least one of the plurality of first switches further comprises a first pull-down transistor which connects the second ends of the first memory capacitors with the first row switch transistor, when turned on, and at least one of the plurality of second switches further comprises a second pull-down transistor which connects the second ends of the second memory capacitors with the second row switch transistor, when turned on, and the apparatus further comprises a third voltage supply which supplies a turn-on voltage to the first pull-down transistor and the second pull-down transistor and a pull-down switch transistor which connects the first and second pull-down transistors with the third voltage supply, when turned on, and the controller turns on the pull-down switch transistor when the plurality of first and second memory capacitors are charged with a voltage, and turns off the pull-down switch transistor when the first current supply and the second current supply a current to the plurality of first and second light emitting parts.

According to an exemplary embodiment of the present invention, the first switch further comprises a first diode which has an anode connected to the first end of the first memory capacitor and a cathode connected to the column switch transistor and a first reset transistor which is connected with the first diode in parallel to make a reverse direction current of the first diode bypass, and the second switch further comprises a second diode which has an anode connected to the first end of the second memory capacitor and a cathode connected to the column switch transistor and a second reset transistor which is connected with the second diode in parallel to make a reverse direction current of the second diode bypass, and the apparatus further comprises a fourth voltage supply which supplies a turn-on voltage to the first and second reset transistors and a reset switch transistor which connects the plurality of first and second reset transistors, with the fourth voltage supply when turned on, and the controller turns on the reset switch transistor after turning off the current switch transistor.

According to an exemplary embodiment of the present invention, the apparatus further comprises a plurality of second light emitting parts which are connected with each other in series, a second current supply which supplies a current to the plurality of second light emitting parts, and a plurality of second switches which are respectively connected with the plurality of second light emitting parts in parallel and make the current be supplied to or bypass the second light emitting parts, and the controller receives brightness information corresponding to the respective second light emitting parts and controls the plurality of second switches to make overall light emitting time of the second light emitting parts within the time intervals correspond to a brightness level of the brightness information.

According to an exemplary embodiment of the present invention, the second switch comprises a second bypass transistor which is connected with the second light emitting part in parallel to make the current bypass the second light emitting part, when turned on.

According to an exemplary embodiment of the present invention, the plurality of first and second light emitting parts comprises a light emitting diode (LED), respectively.

The foregoing and/or other exemplary aspects of the present invention are also achieved by providing a method of controlling a light emitting apparatus which has a plurality of first light emitting parts, the method comprising receiving brightness information corresponding to the plurality of first light emitting parts connected with each other in series, supplying a current to the plurality of first light emitting parts and allowing a current to transmit to the first light emitting parts or allowing a current to bypass the first light emitting parts to make the overall light emitting time of the first light emitting parts within time intervals correspond to a brightness level of the brightness information.

According to an exemplary embodiment of the present invention, the light emitting apparatus further comprises a plurality of second light emitting parts, and the method further comprises receiving brightness information corresponding to the plurality of second light emitting parts connected with each other in series, supplying a current to the plurality of second light emitting parts and allowing a current to transmit to the second light emitting parts or allowing a current to bypass the second light emitting parts to make the overall light emitting time of the second light emitting parts within time intervals correspond to a brightness level of the brightness information.

According to an exemplary embodiment of the present invention, the method further comprises storing control information related to a current transmission of the plurality of first and second light emitting parts independently based on the brightness information.

According to an exemplary embodiment of the present invention, the storing the control information comprises storing the control information of the plurality of first light emitting parts and the plurality of second light emitting parts, sequentially.

According to an exemplary embodiment of the present invention, the supplying the current comprises supplying the current to the plurality of first and second light emitting parts when the control information of the plurality of first and second light emitting parts is completely stored.

According to an exemplary embodiment of the present invention, the method further comprises cutting off a current supply to the plurality of first and second light emitting parts and removing the stored control information of the plurality of first and second light emitting parts.

BRIEF DESCRIPTION OF THE DRAWINGS

The above and/or other aspects and advantages of the present invention will become apparent and more readily appreciated from the following description of exemplary embodiments, taken in conjunction with the accompanying drawings of which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention and are merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness. Reference will now be made in detail to exemplary embodiments of the present invention which are illustrated in the accompanying drawings.

Figure 1A:
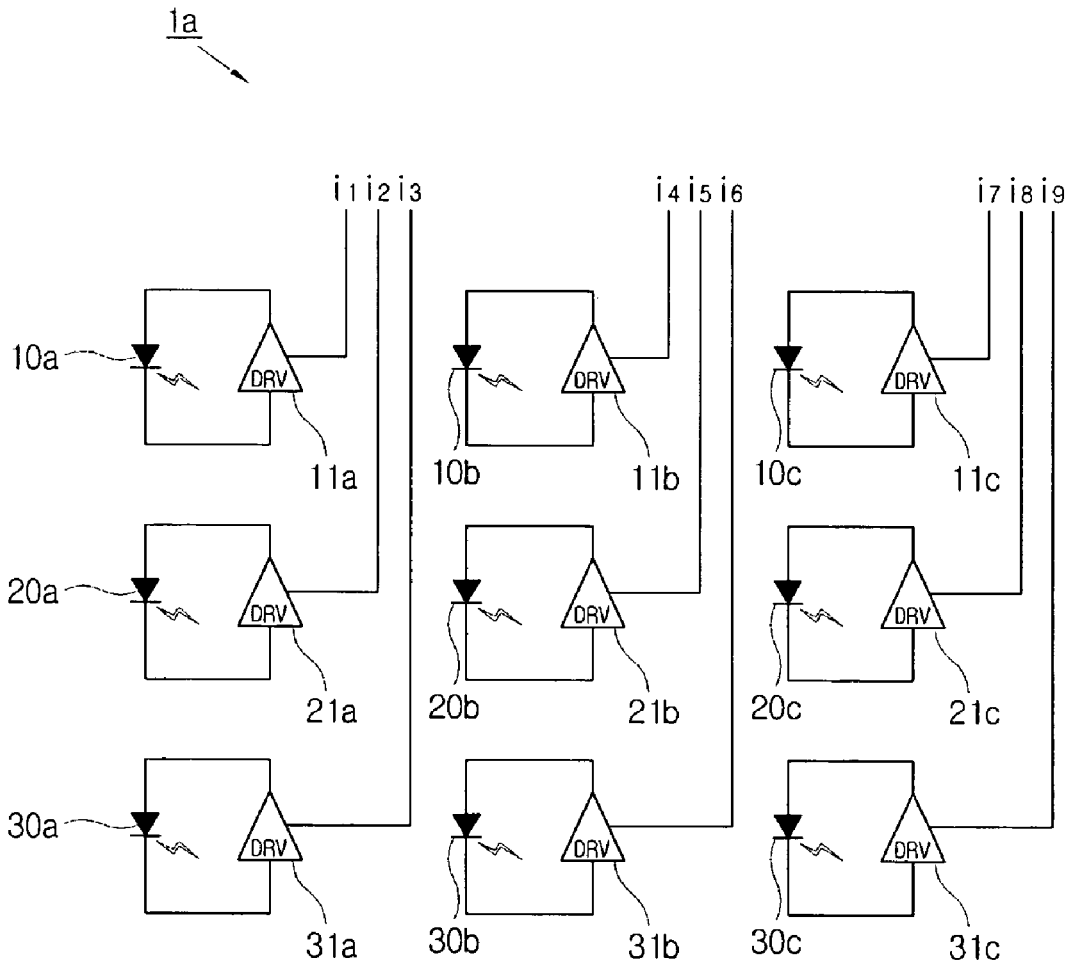
FIG. 1A (PRIOR ART)
FIGS. 1*a* and 1*b* illustrate examples of a conventional light emitting apparatus.
Figure 1B:
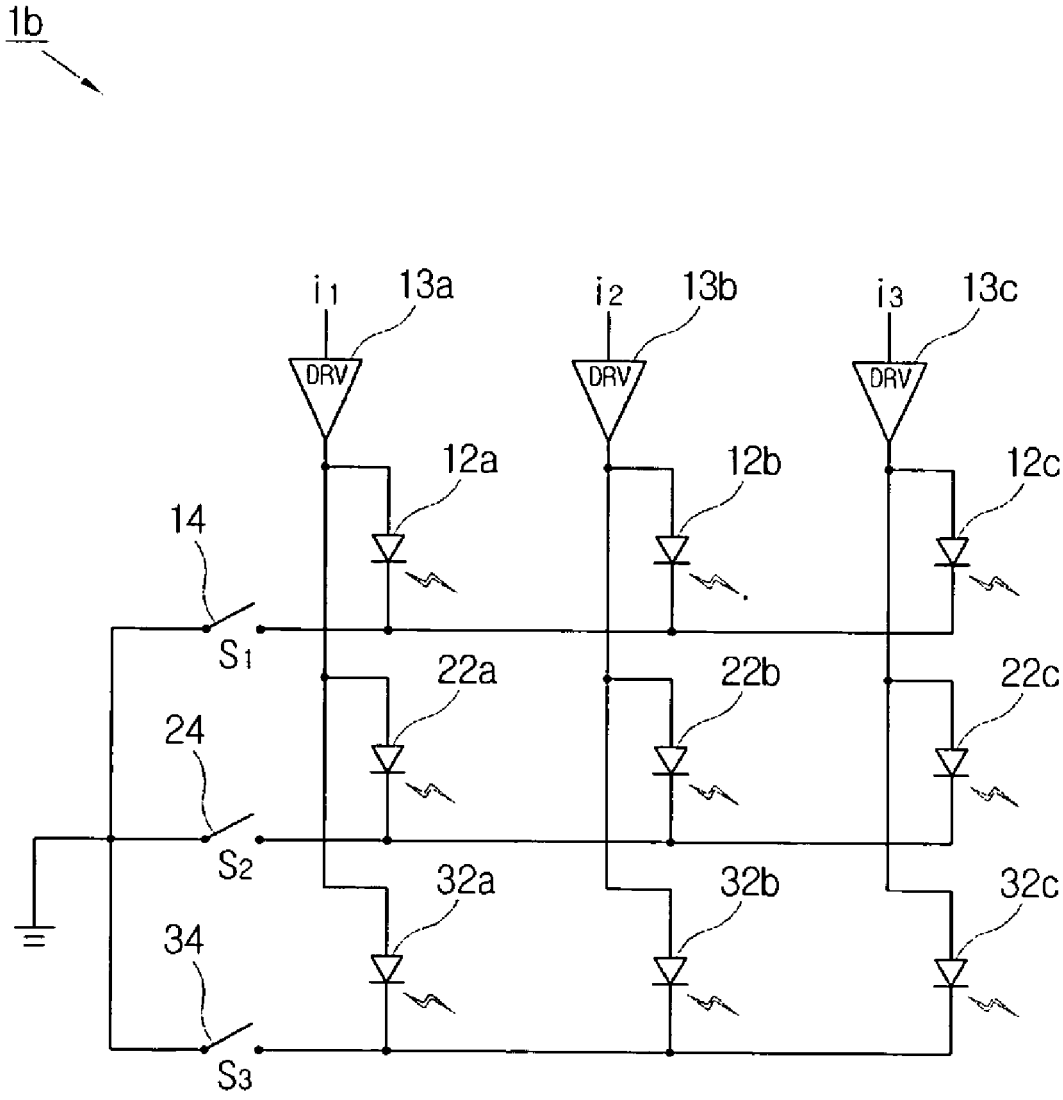
FIG. 1B (PRIOR ART)
Figure 2:
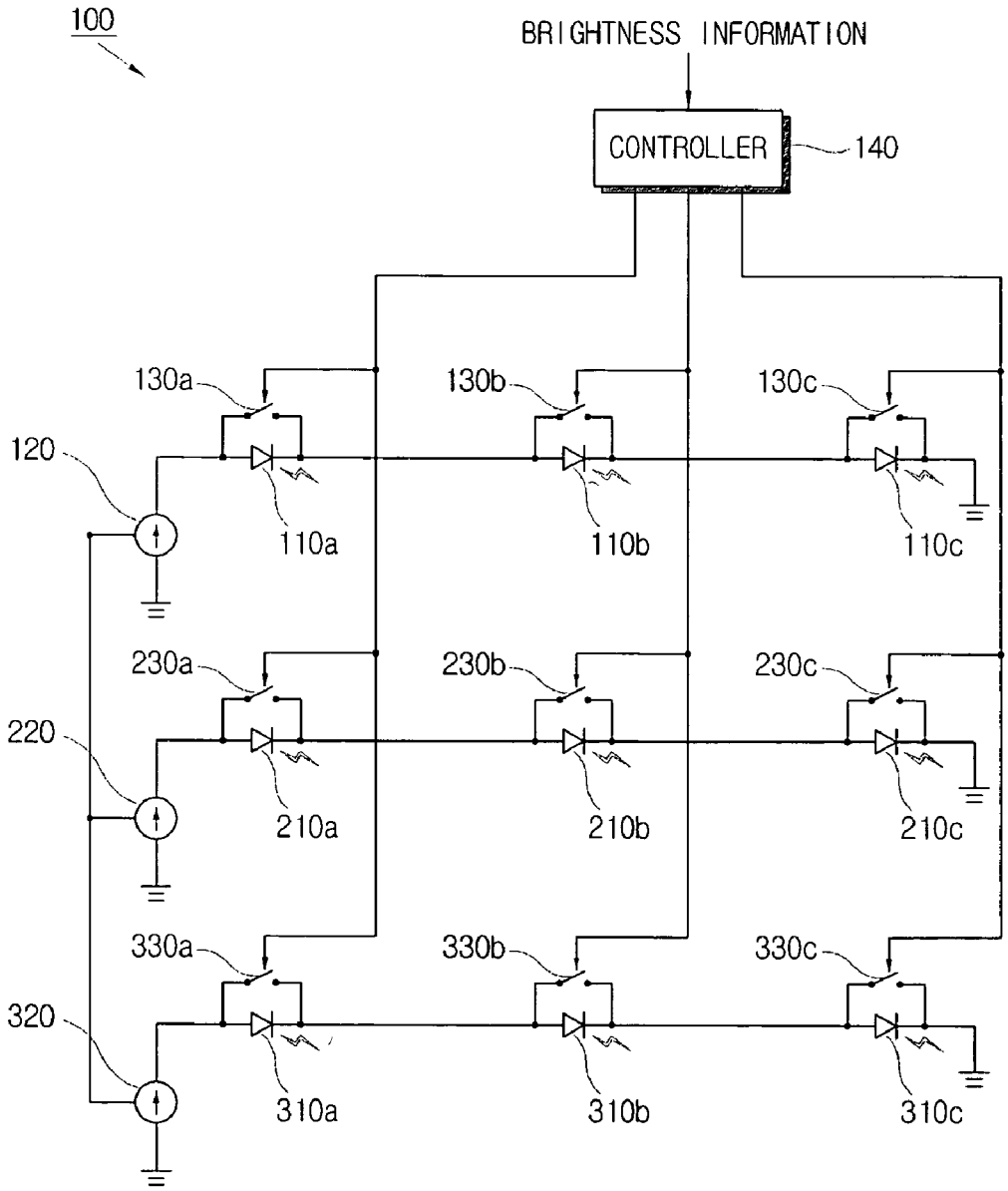
FIG. 2 illustrates a configuration of a light emitting apparatus according to an exemplary embodiment of the present invention.

FIG. 2 illustrates a configuration of a light emitting apparatus 100 according to an exemplary embodiment of the present invention. As shown therein, the light emitting apparatus 100 according to an exemplary embodiment of the present invention comprises nine light emitting parts 110*a* to 110*c*, 210*a* to 210*c* and 310*a* to 310*c* which are arranged in three columns and three rows, three current supplies 120, 220 and 320 which supply a current to the respective rows of the nine light emitting parts 110*a* to 110*c*, 210*a* to 210*c* and 310*a* to 310*c*, nine switches 130*a* to 130*c*, 230*a* to 230*c* and 330*a* to 330*c* which are connected with the nine light emitting parts 110*a* to 110*c*, 210*a* to 210*c* and 310*a* to 310*c* in parallel, and switched on and off to supply or cut off the current with respect thereto and a controller 140 which controls the switches 130*a* to 130*c*, 230*a* to 230*c* and 330*a* to 330*c* to receive brightness information corresponding to the plurality of light emitting parts 110*a* to 110*c*, 210*a* to 210*c* and 310*a* to 310*c* and to make an overall light emitting time of the light emitting parts 110*a* to 110*c*, 210*a* to 210*c* and 310*a* to 310*c* correspond to a brightness level of the brightness information within certain time intervals.

Among the nine light emitting parts 110*a* to 110*c*, 210*a* to 210*c* and 310*a* to 310*c*, the light emitting parts 110*a* to 110*c* in a first row, the light emitting parts 210*a* to 210*c* in a second row and the light emitting parts 310*a* to 310*c* in a third row are referred to as first light emitting parts, second light emitting parts and third light emitting parts, respectively. The respective light emitting parts 110*a* to 110*c*, 210*a* to 210*c* and 310*a* to 310*c* may comprise light emitting diodes (LEDs). The light emitting parts 110*a* to 110*c*, 210*a* to 210*c* and 310*a* to 310*c* of the respective rows are connected with each other in series.

Among the nine switches 130*a* to 130*c*, 230*a* to 230*c* and 330*a* to 330*c*, the switches 130*a* to 130*c* in a first row, the switches 230*a* to 230*c* in a second row and the switches 330*a* to 330*c* in a third row are referred to as first switches, second switches and third switches, respectively. Among the three current supplies 120, 220 and 320, the current supply 120 in a first row, the current supply 220 in a second row and the current supply 320 in a third row are referred to as a first current supply, a second current supply and a third current supply.

The controller 140 controls a time ratio of turning on and off the switches 130*a* to 130*c*, 230*a* to 230*c* and 330*a* to 330*c*, thereby driving the light emitting parts 110*a* to 110*c*, 210*a* to 210*c* and 310*a* to 310*c* to emit light in various gradations and brightness levels as the human eye recognizes the brightness levels of the respective light emitting parts 110*a* to 110*c*, 210*a* to 210*c* and 310*a* to 310*c* differently. The plurality of light emitting parts 110*a* to 110*c*, 210*a* to 210*c* and 310*a* to 310*c* according to an exemplary embodiment of the present invention are shaped like a matrix but are not limited thereto. The plurality of light emitting parts 110*a* to 110*c*, 210*a* to 210*c* and 310*a* to 310*c* may be provided in various shapes. The colors of the respective light emitting parts 110*a* to 110*c*, 210*a* to 210*c* and 310*a* to 310*c* are not limited.

Figure 3:
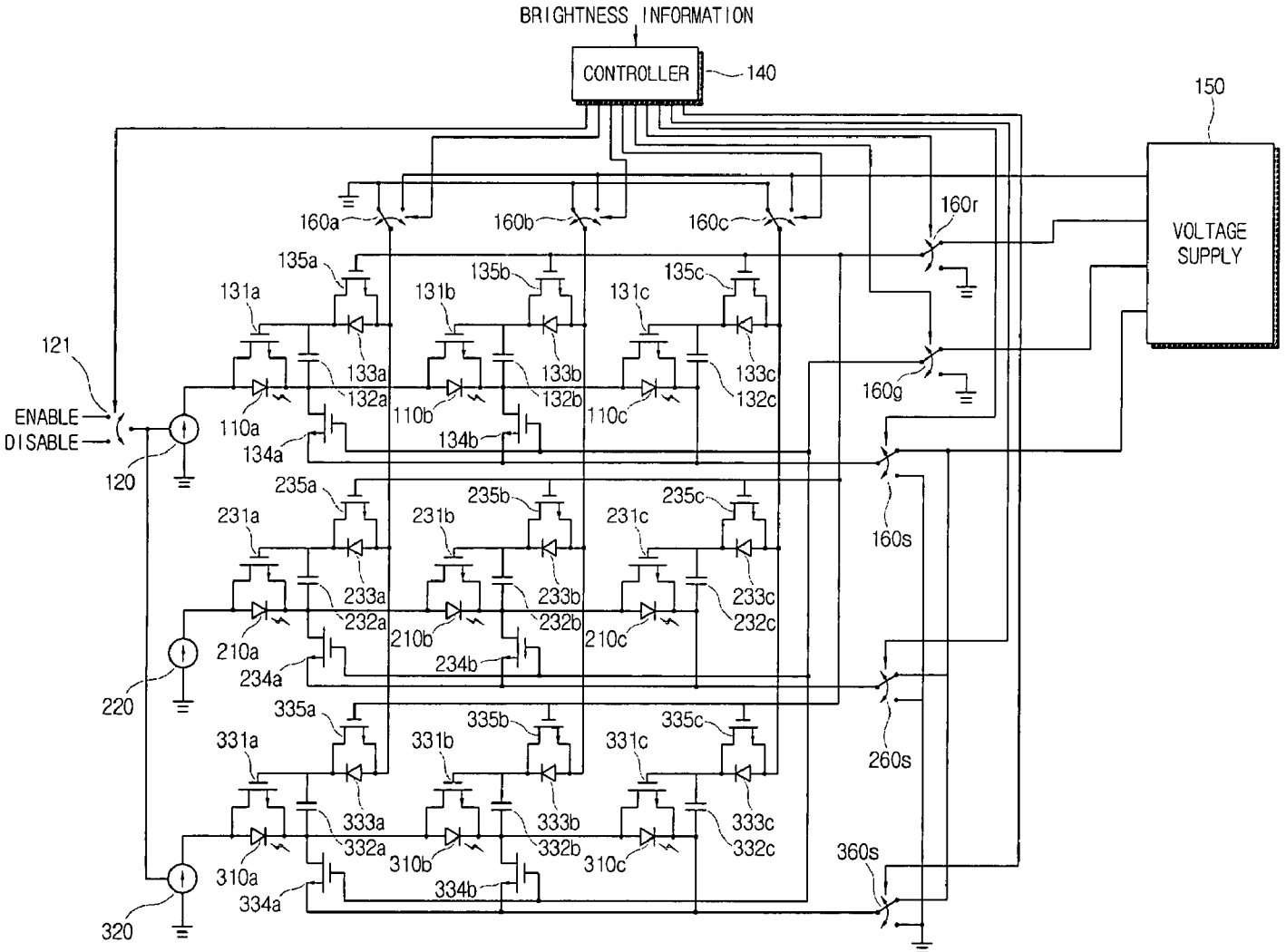
FIG. 3 illustrates a circuit configuration of the light emitting apparatus according to an exemplary embodiment of the present invention.

FIG. 3 illustrates a configuration of the light emitting apparatus 100 according to an exemplary embodiment of the present invention. The respective first switches 130*a* to 130*c* of the light emitting apparatus 100 are connected with the first light emitting parts 110*a* to 110*c* in parallel. The first switches 130*a* to 130*c* of the light emitting apparatus 100 comprise first bypass transistors 131*a* to 131*c* which are connected with the first light emitting parts 110*a* to 110*c* in parallel, and make the current bypass the first light emitting parts 110*a* to 110*c*, when turned on. The first bypass transistors 131*a* to 131*c* may be realized as a Field Effect Transistor (FET), and the like. When implemented as a FET, a drain electrode and a source electrode of each of the first bypass transistors 131*a* to 131*c* are connected with opposite ends of the concerned first light emitting part 110*a*, 110*b* or 110*c*.

Also, the second switches 230*a* to 230*c* and the third switches 330*a* to 330*c* comprise second bypass transistors 231*a* to 231*c* and third bypass transistors 331*a* to 331*c*, respectively. The configuration of the second and third switches 230*a* to 230*c* and 330*a* to 330*c* is the same as that of the first switches 130*a* to 130*c*, other than the additional description.

The first switches 130*a* to 130*c* further comprise first memory capacitors 132*a* to 132*c*, respectively, which may be charged with a voltage. A first end of the first memory capacitors 132*a*, 132*b* or 132*c* is connected with a gate electrode of the corresponding first bypass transistor 131*a*, 131*b* or 131*c*, and a second end thereof is connected with the source electrode of the corresponding first bypass transistor 131*a*, 131*b* or 131*c*.

Also, the second switches 230*a* to 230*c* and the third switches 330*a* to 330*c* comprise second memory capacitors 232*a* to 232*c* and third memory capacitors 332*a* to 332*c*, respectively.

The light emitting apparatus 100 further comprises a voltage supply 150 which supplies a turn-on voltage Va to the first bypass transistors 131*a* to 131*c*, the second bypass transistors 231*a* to 231*c* and the third bypass transistors 331*a* to 331*c*. The light emitting apparatus 100 also comprises three column switch transistors 160*a* to 160*c* which connect the first end of each first memory capacitors 132*a*, 132*b* or 132*c*, each second memory capacitors 232*a*, 232*b* or 232*c*, and each third memory capacitors 332*a*, 332*b* or 332*c*, to an output terminal supplying the turn-on voltage Va or to ground.

When the turn-on voltage Va is supplied to the gate electrode and the source electrode of the first bypass transistors 131*a*, 131*b* or 131*c*, the second bypass transistors 231*a*, 231*b* or 231*c* or the third bypass transistors 331*a*, 331*b* or 331*c*, a current flows between the drain electrode and the source electrode of the corresponding bypass transistor. The current supplied to the corresponding light emitting part of the light emitting parts 110*a*, 110*b*, 110*c*, 210*a*, 210*b*, 210*c*, 310*a*, 310*b* and 310*c* bypasses through the first bypass transistor 131*a*, 131*b* or 131*c*, the second bypass transistor 231*a*, 231*b* or 231*c* or the third bypass transistor 331*a*, 331*b* or 331*c*. The column switch transistors 160*a* to 160*c* may be realized as a FET, and the like.

The voltage supply 150 supplies a voltage Vs which is higher than the turn-on voltage Va, to the first bypass transistors 131*a* to 131*c*, the second bypass transistors 231*a* to 231*c* and the third bypass transistors 331*a* to 331*c*.

The light emitting apparatus 100 further comprises a first row switch transistor 160*s* which connects the second end of the first memory capacitors 132*a* to 132*c* with one of the output terminal of the voltage Vs of the voltage supply 150 or ground, with respect to the first light emitting parts 110*a* to 110*c*. The light emitting apparatus 100 further comprises a second row switch transistor 260*s* and a third row switch transistor 360*s*, with respect to the second light emitting parts 210*a* to 210*c* and the third light emitting parts 310*a* to 310*c*.

The first switches 130*a* and 130*b* further comprise first pull down transistors 134*a* and 134*b*, respectively, which are disposed between the second end of the first memory capacitors 132*a* and 132*b*, and the first row switch transistor 160*s* to connect them, when turned on. The second switches 230*a* and 230*b* and the third switches 330*a* and 330*b* further comprise second pull down transistors 234*a* and 234*b* and third pull down transistors 334*a* and 334*b*, respectively. The first pull down transistors 134*a* and 134*b*, the second pull down transistors 234*a* and 234*b* and the third pull down transistors 334*a* and 334*b* may each be realized as a FET, and the like.

The voltage supply 150 supplies a turn-on voltage Vg to the first pull down transistors 134*a* and 134*b*, the second pull down transistors 234*a* and 234*b* and the third pull down transistors 334*a* and 334*b*. The light emitting apparatus 100 further comprises a pull down switch transistor 160*g* which is disposed between the first pull down transistors 134*a* and 134*b*, the second pull down transistors 234*a* and 234*b* and the third pull down transistors 334*a* and 334*b*, and an output terminal supplying the turn-on voltage Vg of the voltage supply 150, to connect them when tuned on.

The respective first switches 130*a* to 130*c* further comprise a first diode 133*a* 133*b* and 133*c* which has an anode connected to the first end of the first memory capacitor 132*a*, 132*b* and 132*c* and a cathode connected to the column switch transistor 160*a*, 160*b* and 160*c*. The respective first switches 130*a* to 130*c* also comprise a first reset transistor 135*a*, 135*b* and 135*c* which is connected with the first diode 133*a* 133*b* and 133*c* in parallel to allow a reverse current of the first diode 133*a*, 133*b* and 133*c* to bypass, when turned on. The second switches 230*a* to 230*c* and the third switches 330*a* to 330*c* further comprise second reset transistors 235*a* to 235*c* and third reset transistors 335*a* to 335*c*, respectively.

The voltage supply 150 supplies a turn-on voltage Vr to the first reset transistors 135*a* to 135*c*, the second reset transistors 235*a* to 235*c* and the third reset transistors 335*a* to 335*c*. The light emitting apparatus 100 further comprises a reset switch transistor 160*r* which is disposed between the first reset transistors 135*a* to 135*c*, the second reset transistors 235*a* to 235*c* and the third reset transistors 335*a* to 335*c*, and the voltage supply 150, to connect them, when turned on. The voltage supply 150 is merely an exemplary embodiment of the present invention. In another exemplary embodiment, the voltages may be supplied by each of a first voltage supply, a second voltage supply, a third voltage supply and a fourth voltage supply.

The light emitting apparatus 100 further comprises a current switch transistor 121 which allows the first current supply 120, the second current supply 220 and the third current supply 320 to supply a current when turned on and cuts off the current when turned off.

Figure 4:
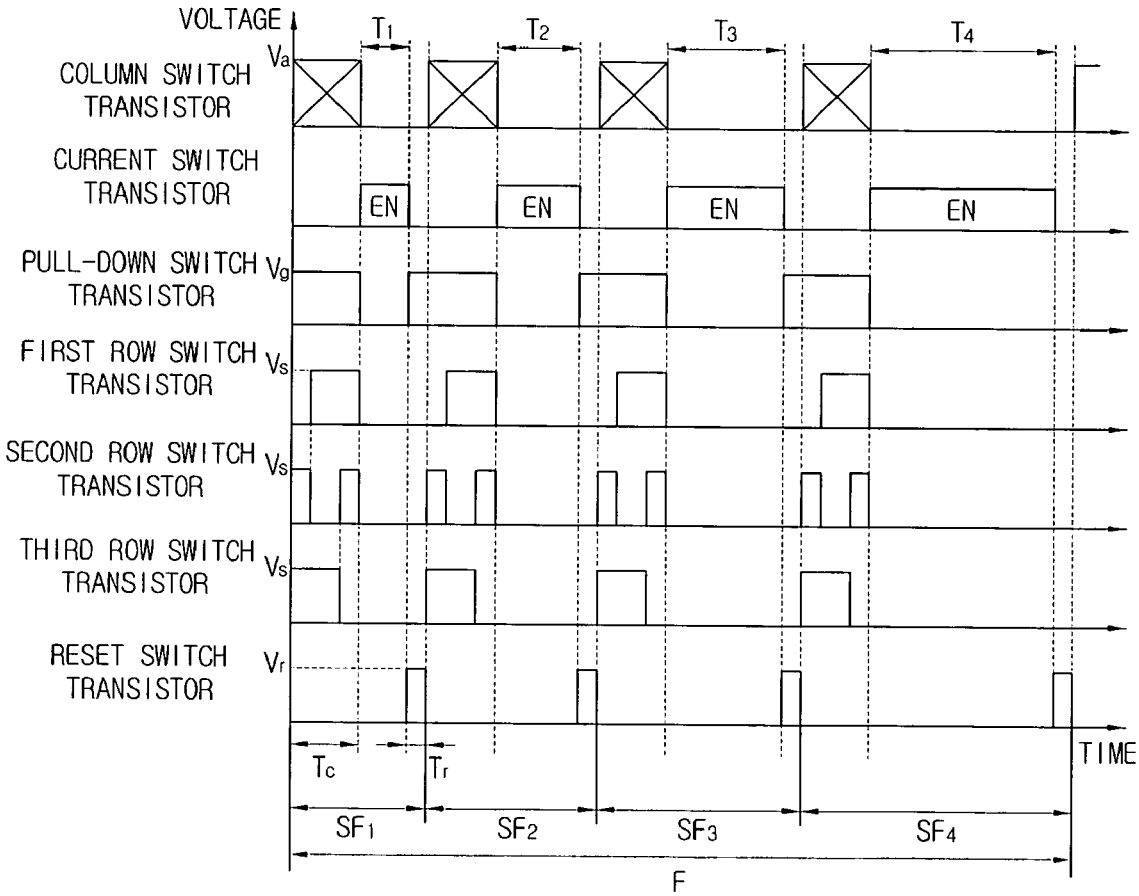
FIG. 4 illustrates a waveform of an operation of a controller according to an exemplary embodiment of the present invention.

FIG. 4 illustrates a waveform of an operation of the controller 140 according to an exemplary embodiment of the present invention. The controller 140 operates using a main frame F as a time interval. The main frame F according to an exemplary embodiment of the present invention comprises 4 sub frames SF1 to SF4 of different time intervals. The controller 140 controls the first memory capacitors 132*a* to 132*c*, the second memory capacitors 232*a* to 232*c* and the third memory capacitors 332*a* to 332*c* to be charged and discharged, and controls the first light emitting parts 110*a* to 110*c*, the second light emitting parts 210*a* to 210*c* and the third light emitting parts 310*a* to 310*c* to emit light, within the respective sub frames SF1 to SF4.

That is, each of the respective sub frames SF1 to SF4 comprise a charging time Tc and a discharging time Tr of the first memory capacitors 132*a* to 132*c*, the second memory capacitors 232*a* to 232*c* and the third memory capacitors 332*a* to 332*c*. The respective sub frames SF1 to SF4 further comprise light emitting times T1 to T4 of the first light emitting parts 110*a* to 110*c*, the second light emitting parts 210*a* to 210*c* and the third light emitting parts 310*a* to 310*c*.

At an initializing stage of the light emitting apparatus 100, the controller 140 discharges the first memory capacitors 132*a* to 132*c*, the second memory capacitors 232*a* to 232*c* and the third memory capacitors 332*a* to 332*c*, to a zero voltage or ground, and turns off the current switch transistor 121 and the reset switch transistor 160*r*.

The controller 140 turns on the pull down switch transistor 160*g* when the first memory capacitors 132*a* to 132*c*, the second memory capacitors 232*a* to 232*c* and the third memory capacitors 332*a* to 332*c* are charged with a voltage. Thus, the turn-on voltage Vg of the voltage supply 150 is supplied to the first pull down transistors 134*a* and 134*b*, the second pull down transistors 234*a* and 234*b* and the third pull down transistors 334*a* and 334*b* to be turned on.

When a voltage is to be charged to the first memory capacitors 132*a* to 132*c*, the controller 140 controls the first row switch transistor 160*s*, the second row switch transistor 260*s* and the third row switch transistor 360*s* to be switched on and off to connect the second end of the first memory capacitors 132*a* to 132*c* to the ground, and to connect the second end of the second memory capacitors 232*a* to 232*c* and the third memory capacitors 332*a* to 332*c* to an output terminal of the voltage Vs of the voltage supply 150. As the second end of the first memory capacitors 132*a* to 132*c* is connected to the ground, the first memory capacitors 132*a* to 132*c* are charged with the voltage Va supplied to a first end thereof. Meanwhile, the voltage Vs supplied to the second end of the second memory capacitors 232*a* to 232*c* and the third memory capacitors 332*a* to 332*c* is higher than the voltage Va supplied to the first end thereof, the second memory capacitors 232*a* to 232*c* and the third memory capacitors 332*a* to 332*c* are not charged.

When the first memory capacitors 132*a* to 132*c* are charged, the controller 140 controls the column switch transistors 160*a* to 160*c* to be independently switched on and off based on the input brightness information of the respective first light emitting parts 110*a* to 110*c*. Then, the voltage Va or ground voltage is supplied to the first end of the first memory capacitor 132*a*, 132*b* or 132*c* through the first diode 133*a*, 133*b* or 133*c*, thereby charging the first memory capacitor 132*a*, 132*b* or 132*c*. Also, the controller 140 controls the first row switch transistor 160*s*, the second row switch transistor 260*s* and the third row switch transistor 360*s* to be switched on and off to charge the second memory capacitors 232*a* to 232*c* and the third memory capacitors 332*a* to 332*c*. As a gate voltage of the first bypass transistor 131*a*, 131*b* or 131*c*, the second bypass transistor 231*a*, 231*b* or 231*c*, or the third bypass transistor 331*a*, 331*b* or 331*c* in the row except the charged row, is same or identical with/to the voltage Va, the first diode 133*a*, 133*b* or 133*c*, the second diode 233*a*, 233*b* or 233*c* or the third diode 333*a*, 333*b* or 333*c* is biased in a reverse direction, the charged state of the first memory capacitor 132*a*, 132*b* or 132*c*, the second memory capacitor 232*a*, 232*b* or 232*c* or the third memory capacitor 332*a*, 332*b* or 332*c* is not changed.

When the first memory capacitors 132*a* to 132*c*, the second memory capacitors 232*a* to 232*c* and the third memory capacitors 332*a* to 332*c* are fully charged, the controller 140 turns off the pull down switch transistor 160*g* to turn off the first pull down transistors 134*a* and 134*b*, the second pull down transistors 234*a* and 234*b* and the third pull down transistors 334*a* and 334*b*. Then, a terminal which is opposite to a terminal through which the current is supplied to the first light emitting part 110*c*, the second light emitting part 210*c* and the third light emitting part 310*c*, and a second end of the first memory capacitor 132*c*, the second memory capacitor 232*c* and the third memory capacitor 332*c* are connected to the ground. The controller 140 turns on the current switch transistor 121 to simultaneously supply the current to the first light emitting parts 110*a* to 110*c*, the second light emitting parts 210*a* to 210*c* and the third light emitting parts 310*a* to 310*c*.

The current bypasses the first light emitting parts 110*a* to 110*c*, the second light emitting parts 210*a* to 210*c* and the third light emitting parts 310*a* to 310*c* through the first bypass transistors 131*a* to 131*c*, the second bypass transistors 231*a* to 231*c* and the third bypass transistors 331*a* to 331*c*, and flows to the first memory capacitors 132*a* to 132*c*, the second memory capacitors 232*a* to 232*c* and the third memory capacitors 332*a* to 332*c*. The first light emitting parts 110*a* to 110*c*, the second light emitting parts 210*a* to 210*c* and the third light emitting parts 310*a* to 310*c* independently emit light corresponding to the brightness information, according to whether the first memory capacitors 132*a* to 132*c*, the second memory capacitors 232*a* to 232*c* and the third memory capacitors 332*a* to 332*c* are charged with the voltage.

When it is determined that the light emitting time T1 has elapsed corresponding to the first sub frame SF1 after the current switch transistor 121 is turned on, the controller 140 turns off the current switch transistor 121 and turns on the pull down switch transistor 160*g*, thereby turning on the first pull down transistors 134*a* and 134*b*, the second pull down transistors 234*a* and 234*b* and the third pull down transistors 334*a* and 334*b*. Also, the controller 140 turns on the reset switch transistor 160*r* to turn on the first reset transistors 135*a* to 135*c*, the second reset transistors 235*a* to 235*c* and the third reset transistors 335*a* to 335*c*, and connects the column switch transistors 160*a* to 160*c* to ground.

Thus, the voltage charged in the first memory capacitors 132*a* to 132*c*, the second memory capacitors 232*a* to 232*c* and the third memory capacitors 332*a* to 332*c* bypasses through the corresponding first reset transistors 135*a* to 135*c*, the second reset transistors 235*a* to 235*c* and the third reset transistors 335*a* to 335*c* to be discharged to ground.

When the operation in the first sub frame SF1 is completed, the controller 140 sequentially controls operation in the remaining sub frames SF2 to SF4, as described above.

Figure 5:
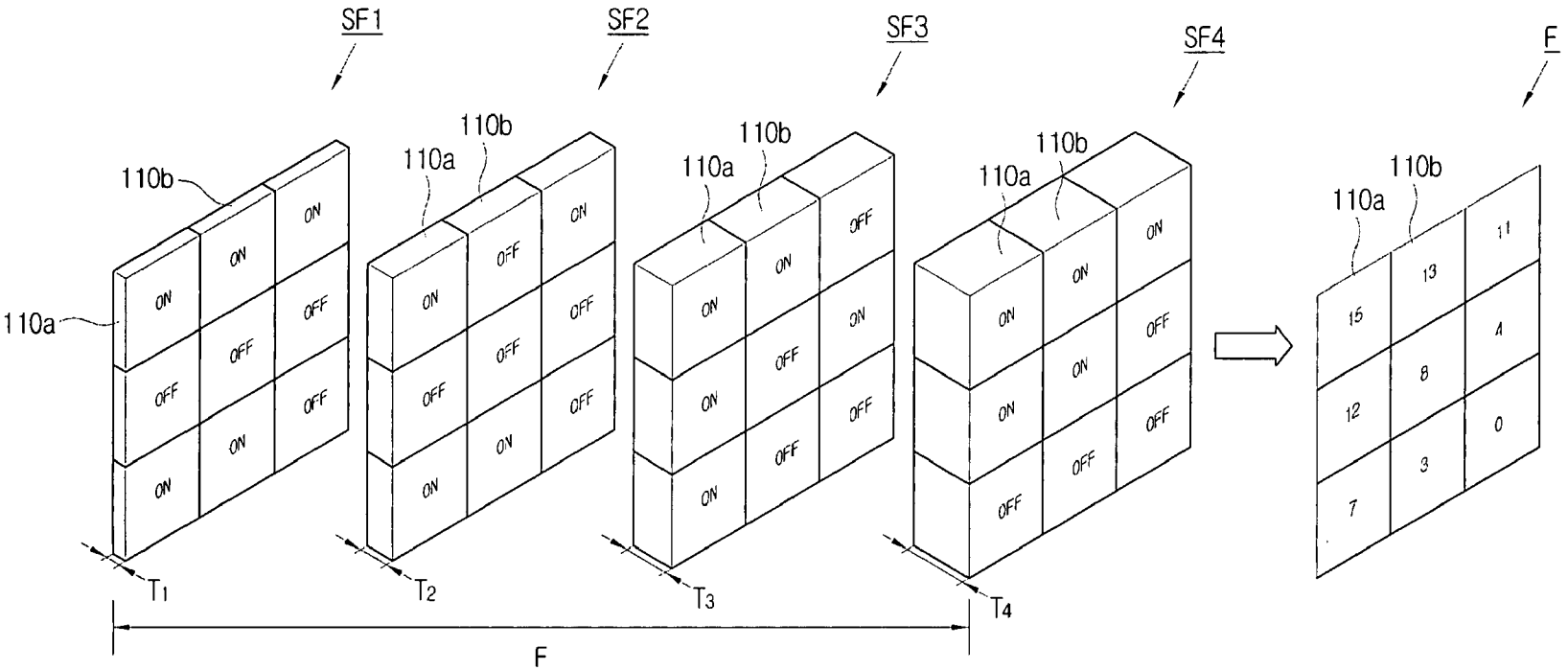
FIG. 5 illustrates the relation between light emitting time of a light emitting part and brightness according to an exemplary embodiment of the present invention.

FIG. 5 illustrates the relation between the light emitting time of the light emitting parts 110*a* to 110*c*, 210*a* to 210*c* and 310*a* to 310*c* according to an exemplary embodiment of the present invention, and the brightness levels. When the input brightness information has a level of 2*n*, the light emitting parts 110*a* to 110*c*, 210*a* to 210*c* and 310*a* to 310*c* realize the brightness in various gradations through sub frames in an N number having charging time ratio of 1:2 . . . :2n. For example, when the brightness information respectively input to the light emitting parts 110*a* to 110*c*, 210*a* to 210*c* and 310*a* to 310*c* has levels of 0-15, the ratio of the light emitting times T1 to T4 of the sub frames SF1 to SF4 may be 1:2:4:8. As shown therein, when the light emitting part 110*a* emits light in the respective 4 sub frames SF1 to SF4, the average brightness of the light emitting part 110*a* has a brightness level of 15 (=1+2+4+8). When the light emitting part 110*b* sequentially emits light in the sub frame SF1, does not emit light in the sub frame SF2, and emits light in the sub frames SF3 and SF4, the average brightness of the light emitting part 110*b* has a brightness level of 13(1+0+4+8). As the light emitting parts 110*a* to 110*c*, 210*a* to 210*c* and 310*a* to 310*c* independently emit light in the sub frames SF1 to SF4, various levels of brightness can be realized corresponding to the input brightness information.

Figure 6:
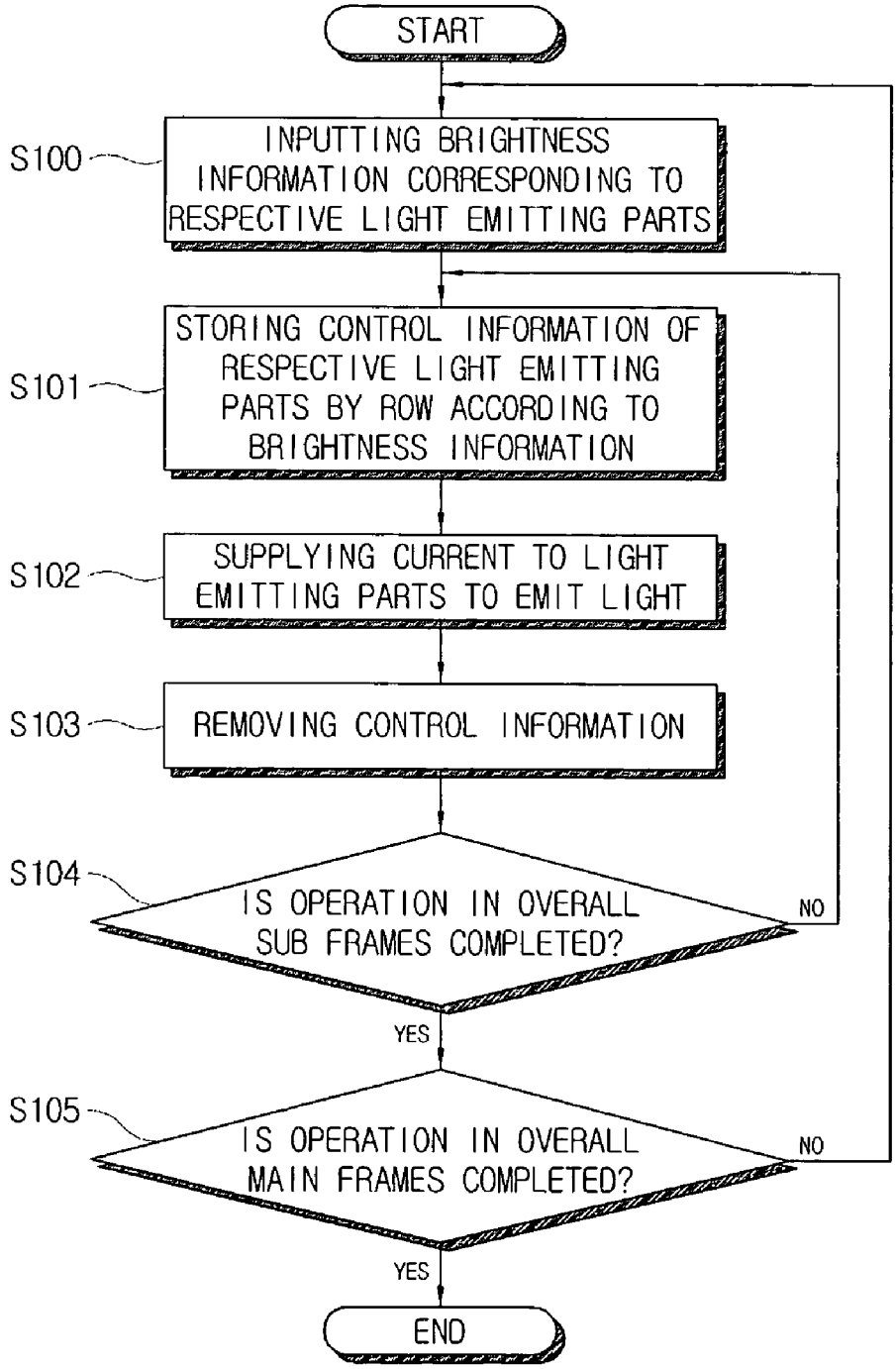
FIG. 6 is a control flowchart of a light emitting apparatus according to an exemplary embodiment of the present invention.

FIG. 6 is a control flowchart of the light emitting apparatus 100 according to an exemplary embodiment of the present invention. The brightness information is input corresponding to the respective light emitting parts 110*a* to 110*c*, 210*a* to 210*c* and 310*a* to 310*c* in the concerned main frame (S100). Control information corresponding to the light emitting parts 110*a* to 110*c*, 210*a* to 210*c* and 310*a* to 310*c* is stored by row according to the input brightness information (S100). The control information comprises information on whether the current is supplied to or bypasses the light emitting parts 110*a* to 110*c*, 210*a* to 210*c* and 310*a* to 310*c* in the concerned sub frames. The control information is set to make the overall light emitting time of the respective light emitting parts 110*a* to 110*c*, 210*a* to 210*c* and 310*a* to 310*c* correspond to the brightness level of the brightness information in the main frame.

When the control information is fully stored with respect to the overall rows in the concerned sub frames, the current is supplied to the light emitting parts 110*a* to 110*c*, 210*a* to 210*c* and 310*a* to 310*c*. As the current is supplied to or bypasses the light emitting parts 110*a* to 110*c*, 210*a* to 210*c* and 310*a* to 310*c* based on the stored control information, the light emitting parts 110*a* to 110*c*, 210*a* to 210*c* and 310*a* to 310*c* independently emit light (S102). As described above, the light emitting time in the concerned sub frames, is set to correspond to the brightness level of the brightness information. When the light emitting parts 110*a* to 110*c*, 210*a* to 210*c* and 310*a* to 310*c* complete the light emitting operation in the concerned sub frames, the stored control information is removed (S103). Then, it is determined whether the operation in the overall sub frames is completed (S104). When it is determined that the operation in the sub frames is not completed, the control information is stored according to the brightness information with respect to the next sub frame (S101).

When it is determined that the operation in the overall sub frames is completed, it is determined whether the operation in the overall main frames is completed (S105). When it is determined that the operation in the overall main frames is not completed, the brightness information corresponding to the concerned main frame is input (S100). When it is determined that the operation in the overall main frames is completed, the operation is completed.

As described above, exemplary embodiments of the present invention provide a light emitting apparatus which drives a plurality of light emitting parts to independently emit light in various brightness levels with a simplified circuit configuration and improved efficiency.

Although a few exemplary embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A light emitting apparatus, the apparatus comprising:

a plurality of first light emitting parts which are connected with each other in series and a plurality of second light emitting parts connected with each other in series;

a first and second current supply for supplying a first and second current to the plurality of first and second light emitting parts, respectively; and a plurality of first switches respectively connected in parallel with the plurality of first light emitting parts for selectively bypassing the first current supplied to the first light and a plurality of second switches respectively connected in parallel with the plurality of second light emitting parts for bypassing the second light emitting parts, wherein;

a controller for receiving brightness information corresponding to each of the plurality of first and second light emitting parts and for controlling the plurality of first and second switches to make an overall light emitting time of each of the plurality of first and second light emitting parts within desired time intervals correspond to a brightness level of the brightness information.

2. The apparatus according to claim 1, wherein each of the plurality of first switches comprises a first bypass transistor respectively connected in parallel with the plurality of the first light emitting parts for bypassing the current to the first light emitting parts.

3. The apparatus according to claim 2, further comprising:

a plurality of second light emitting parts which are connected with each other in series;

a second current supply for supplying a second current to the plurality of second light emitting parts; and a plurality of second switches respectively connected in parallel with the plurality of second light emitting parts for bypassing the second current supplied to the second light emitting parts, wherein the controller receives brightness information corresponding to each of the plurality of second light emitting parts and for controlling the plurality of second switches to make an overall light emitting time of each of the plurality of second light emitting parts within the desired time intervals correspond to a brightness level of the brightness information.

4. The apparatus according to claim 3, wherein each of the plurality of second switches comprises a second bypass transistor respectively connected in parallel with the plurality of the second light emitting parts for bypassing the current to the second light emitting parts.

5. The apparatus according to claim 4, wherein each of the plurality of first switches further comprise a first memory capacitor connected with the first bypass transistor for charging with a voltage, and wherein each of the plurality of second switches further comprise a second memory capacitor connected with the second bypass transistor for charging with a voltage.

6. The apparatus according to claim 5, further comprising:

a first voltage supply for supplying a turn-on voltage to each of the plurality of first bypass transistors and each of the plurality of second bypass transistors; and a plurality of column switch transistors for connecting first ends of the plurality of first memory capacitors and first ends of the plurality of second memory capacitors with one of the first voltage supply and ground, wherein the controller controls the plurality of column switch transistors to be independently switched on and off based on the respective brightness information of the plurality of first and second light emitting parts.

7. The apparatus according to claim 6, further comprising:

a current switch transistor for controlling the first current supply and the second current supply, wherein the controller controls the current switch transistor.

8. The apparatus according to claim 7, further comprising:

a second voltage supply for supplying a second voltage which is higher than the turn-on voltage of the first voltage supply;

a first row switch transistor for connecting second ends of the plurality of first memory capacitors with one of the second voltage supply and ground; and a second row switch transistor for connecting second ends of the plurality of second memory capacitors with one of the second voltage supply and ground, wherein the controller controls the first row switch transistor to connect the second ends of the plurality of first memory capacitors to ground and the second row switch transistor to connect the second ends of the plurality of second memory capacitors to the second voltage supply.

9. The apparatus according to claim 8, wherein at least one of the plurality of first switches further comprises a first pull-down transistor for connecting the second ends of the first memory capacitors with the first row switch transistor, wherein at least one of the plurality of second switches further comprises a second pull-down transistor for connecting the second ends of the second memory capacitors with the second row switch transistor, and wherein the apparatus further comprises:

a third voltage supply for supplying a turn-on voltage to the first pull-down transistor and the second pull-down transistor; and a pull-down switch transistor for connecting the first and second pull-down transistors with the third voltage supply, wherein the controller controls the pull-down switch transistor to supply a voltage when the plurality of first and second memory capacitors are charged with a voltage, and controls the pull-down switch transistor to isolate when the first current supply and the second current supply a current to the plurality of first and second light emitting parts.

10. The apparatus according to claim 9, wherein the first switch further comprises:

a first diode comprising an anode connected to the first end of the first memory capacitor and a cathode connected to the column switch transistor; and a first reset transistor connected in parallel with the first diode for bypassing a reverse current of the first diode, wherein the second switch further comprises:

a second diode comprising an anode connected to the first end of the second memory capacitor and a cathode connected to the column switch transistor; and a second reset transistor connected in parallel with the second diode for bypassing a reverse current of the second diode, and wherein the apparatus further comprises:

a fourth voltage supply for supplying a turn-on voltage to the first and second reset transistors; and a reset switch transistor connecting the first and second reset transistors with the fourth voltage supply, wherein the controller controls the reset switch transistor after turning off the current switch transistor.

11. The apparatus according to claim 1, wherein the second switch comprises a second bypass transistor connected in parallel with the second light emitting part for bypassing the current bypass to the second light emitting part.

12. The apparatus according to claim 1, wherein the plurality of first light emitting parts comprises a light emitting diode (LED), respectively.

13. The apparatus according to claim 1, wherein the desired time intervals comprise at least two time intervals and further wherein each of the desired time intervals vary in duration from the other desired time intervals.

14. The apparatus according to claim 1, wherein the brightness information corresponding to each of the plurality of first light emitting parts includes an average brightness level over a predetermined period of time for each of the plurality of first light emitting parts.

15. A method of controlling a light emitting apparatus, the method comprising:

receiving brightness information corresponding to a plurality of first light emitting parts connected with each other in series and to a plurality of second light emitting parts connected with each other in series;

selectively performing one of supplying a current to the first light emitting parts and allowing the supplied current to bypass the first light emitting parts to make an overall light emitting time of the first light emitting parts within time intervals correspond to a brightness level of the brightness information; and selectively performing one of supplying a current to the second light emitting parts and allowing the supplied current to bypass the second light emitting parts to make an overall light emitting time of the second light emitting parts within time intervals correspond to a brightness level of the brightness information.

16. The method according to claim 15, further comprising:

storing control information related to a transmission of the plurality of first and second light emitting parts independently based on the brightness information.

17. The method according to claim 16, wherein the storing the control information comprises storing the control information of the plurality of first light emitting parts and the plurality of second light emitting parts, sequentially.

18. The method according to claim 17, wherein the supplying the current comprises supplying the current to the plurality of first and second light emitting parts when the control information of the plurality of first and second light emitting parts is completely stored.

19. The method according to claim 18, the method further comprising:

stopping a current supply to the plurality of first and second light emitting parts and removing the stored control information of the plurality of first and second light emitting parts.

20. The method according to claim 15, wherein the brightness information corresponding to each of the plurality of first light emitting parts includes an average brightness level over a predetermined period of time for each of the plurality of first light emitting parts.

* * * * *

UNITED STATES PATENT AND TRADEMARK OFFICE

CERTIFICATE OF CORRECTION

PATENT NO. : 7,646,154 B2
APPLICATION NO. : 11/589809
DATED : January 12, 2010
INVENTOR(S) : Kang et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 225 days.

Signed and Sealed this

Sixteenth Day of November, 2010

David J. Kappos

David J. Kappos
*Director of the United States Patent and Trademark Office*